US005097981A

United States Patent [19]

Degasperi et al.

[11] Patent Number: 5,097,981

[45] Date of Patent: Mar. 24, 1992

[54] POINT-OF-PURCHASE COUPON DISPENSER

[75] Inventors: Thomas A. Degasperi, Bellport; John A. Nucatola, Hauppauge; Scott E. Manzo, Calverton, all of N.Y.

[73] Assignee: Totom Enterprises, Inc., Bohemia, N.Y.

[21] Appl. No.: 573,450

[22] Filed: Aug. 24, 1990

Related U.S. Application Data

[63] Continuation-in-part of Ser. No. 464,416, Jan. 12, 1990, abandoned.

[51] Int. Cl.[5] ..... G07F 11/00

[52] U.S. Cl. ..... 221/3; 221/6; 221/231

[58] Field of Search ..... 221/3, 2, 6, 18, 13, 221/9, 231, 232, 259, 258; 222/52, 63; 271/113, 110, 126

[56] References Cited

U.S. PATENT DOCUMENTS

| | | | |
|---|---|---|---|
| 3,186,588 | 6/1965 | Chapman | 221/3 |
| 3,260,402 | 7/1966 | Lareau et al. | 221/6 |
| 4,039,181 | 8/1977 | Prewer | 221/3 |
| 4,717,043 | 1/1988 | Groover et al. | 221/13 |
| 4,876,532 | 10/1989 | Sauls | 221/3 |
| 4,946,070 | 8/1990 | Albert et al. | 222/52 |
| 4,954,697 | 9/1990 | Kokubun et al. | 221/3 |

FOREIGN PATENT DOCUMENTS

| | | | |
|---|---|---|---|
| 3726936 | 2/1989 | Fed. Rep. of Germany | 221/3 |

*Primary Examiner*—Robert P. Olszewski
*Assistant Examiner*—Kenneth Noland
*Attorney, Agent, or Firm*—Galgano & Belkin

[57] ABSTRACT

A self-powered, compact intelligent device senses the proximity of a consumer and draws their attention by emitting either a low level beeping sound or a 5-15 second or longer "audible commercial" or other audio/visual signal while simultaneously presenting promotional material. This point-of-purchase coupon dispenser POP-CD offers the consumer the convenience of individual, point-of-purchase coupons for immediate use.

20 Claims, 5 Drawing Sheets

POINT-OF-PURCHASE COUPON DISPENSER

RELATED APPLICATIONS

This application is a continuation-in-part of application Ser. No. 464,416, filed Jan. 12, 1990 now abandoned.

BACKGROUND OF THE INVENTION

The invention relates to a point-of-purchase coupon dispenser for dispensing coupons or the like. More particularly, the invention concerns an automatic coupon dispensing machine with means for sensing proximity of a consumer and means for attracting the attention of the consumer.

In recent years, the number and value of grocery coupons distributed has steadily increased yet consumer redemption has steadily decreased.

Consumer behavior and the understanding of it has led to the need for Point-of-Sales marketing. In 1988 the Point-of-Purchasing Advertising Institute surveyed 50,000 consumers in the act of buying and found that:

90% had not looked at promotional circulars

86% had not heard broadcast messages

80% were not redeeming coupons

75% had not checked store ads

Moreover, media used for advertising includes prime time network television. Over the last decade, however, the networks' share of the audience has dropped from 92% to 67% according to A. C. Nielson Co. and the daytime audience has fallen from 78% down to 57%. Yet the cost of 30 seconds of prime time network air time has increased 85%. See, Stalking the New Consumer, Business Week, Aug. 28, 1989.

A study was conducted in 1988 to review the redemption rates of grocery coupons for the year 1987 compared with 1988. See, Progressive Grocer, October 1988. The results of this study are as follows:

| Source of Coupons | % Redemption | % Change |
|---|---|---|
| Daily Newspaper | 4.0% | −25% |
| Sunday Newspaper | 4.8% | −27% |
| Magazines | 5.4% | −19% |
| Direct Mail | 5.8% | −28% |
| Instant On-Pack | 31.0% | +11% |

It can be seen that the instant on-pack coupon (instant redemption coupon attached to a product and redeemed at the check out counter) shows an impressive 31% redemption rate and is the only coupon distribution vehicle that has shown an increase in redemption since 1984. Id.

Consumer research also shows that: "Two thirds of all buying decisions are made in the store." Thus, advertisers should concentrate their efforts on in-store promotion.

Under these conditions, it is apparent that a point-of-sales marketing program holds the greatest redemption percentage of any other coupon distribution method in use today. A clear indication of this is the 300–600% increase in product movement typically experienced on the day of an in-store product demonstration.

Manufacturers and retailers are thus challenged to offer an innovative point-of-sales promotional method that satisfies the stringent convenience requirements of consumers while generating greater sustained levels of product awareness. The Automatic Coupon Machine of the present invention provides the consumer with convenience, value, and time savings.

DESCRIPTION OF THE PRIOR ART

U.S. Pat. No. 4,530,200 discloses a dispensing arrangement for advertising coupons which is used to automatically feed the coupons into egg cartons and the like.

U.S. Pat. No. 3,753,514 discloses a vending machine for dispensing flat articles, in particular postcards and the like.

U.S. Pat. No. 3,887,106 discloses a ticket cartridge, hopper and stacker for dispensing merchandise tickets.

U.S. Pat. No. 4,890,093, discloses a solar powered proximity triggered light.

The complete disclosure of each of the U.S. Patents discussed above, namely U.S. Pat. Nos. 4,890,093; 4,530,200; 3,887,106; and 3,753,514, is incorporated herein by reference.

SUMMARY OF THE INVENTION

Accordingly, it is an object of the invention to provide an improved method for distributing manufacturers' or retailers' promotional material directly to the consumer at the time the decision to purchase is being made by the consumer.

Another object of the invention is to provide a dispensing device in a small, self contained enclosure which can be located in the vicinity of a relevant product display without detracting from the product display.

A further object of the invention is to attract the attention of consumers as they approach or pass a product display and to visibly dispense promotional material such as a coupon.

The above and other objects are achieved by the inventive Point-of-Purchase Coupon Dispenser (POP-CD), for dispensing of promotional material. The point-of-purchase coupon dispenser includes coupon storage means for storing a plurality of coupons, coupon exit means, and means for rejecting coupons, one at a time, from the storage means through the exit means. Audio/-visual means are also provided for attracting the attention of the consumer. Activation means are operatively connected to the audio/visual means and the means for rejecting coupons to effect activation thereof. The preferred embodiment of the POP-CD is designed to be mounted on the front portion of a retail shelf directly in front of the product specified on the promotional material to be dispensed (i.e, at the point-of-purchase or point-of-display). The POP-CD automatically detects the proximity of a consumer with the use of a sensor. Upon detecting the presence of a consumer, the POP-CD activates audio/visual means to attract a consumer's attention and dispenses a coupon or similar promotional device.

While maintaining small size requirements, a preferred embodiment of the POP-CD can hold up to 1000 pieces of promotional material, such as coupons, in a tray which can be reloaded and exchanged with empty trays in a matter of seconds without the use of special tools. Means are also provided to mount the POP-CD on a wide range of product display shelves.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as definition of the limits of the invention.

In the drawings, wherein similar reference characters denote similar elements throughout the several views:

FIG. 6*a* is a top view, FIG. 6*b* is a side elevation looking in the direction B shown in FIG. 6*a; * and FIG. 6*c* is a side elevation looking in the direction C shown in FIG. 6*a;*

FIG. 8 shows a side view of the POP-CD universal mounting clamp and its relationship to the shelf it is mounted on.

DETAILED DESCRIPTION OF THE PREFERRED EMBODIMENTS

Figure 1:
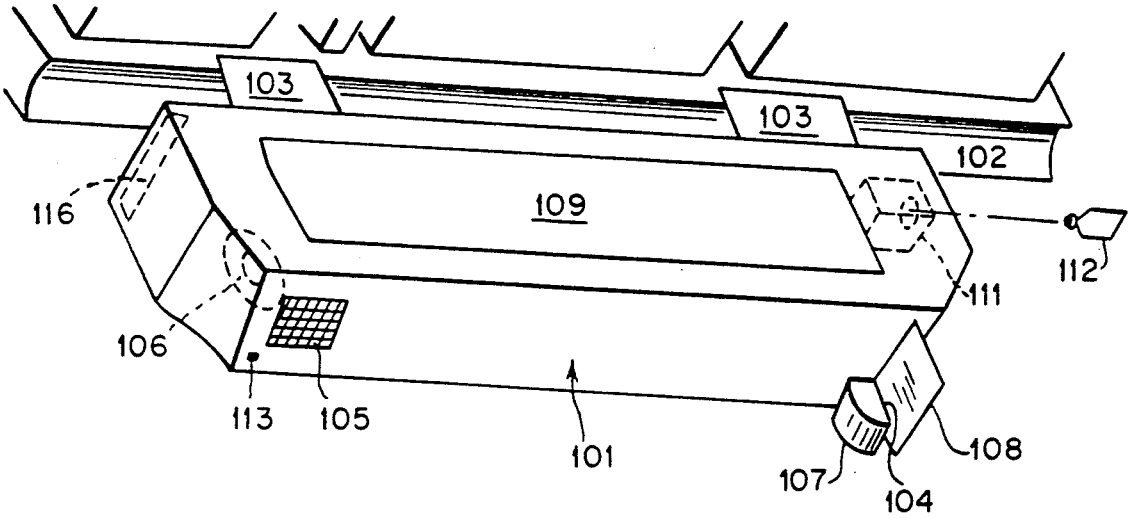
FIG. 1 shows a perspective view of a preferred embodiment of the Point-of-Purchase Coupon Dispenser (POP-CD) mounted on a typical product display shelf with a coupon in the exit position.

Referring now to FIG. 1, a preferred embodiment of the Point-of-Purchase Coupon Dispenser (POP-CD) 101 is shown mounted on a retail store shelf 102 with the use of brackets 103. The overall dimensions of the POP-CD 101 are preferably such that it may be so mounted on display shelf 102 without eclipsing products displayed on the shelf. Nevertheless, the POP-CD can be configured several different ways as will become apparent in the following description.

The preferred embodiment of the POP-CD 101 is provided with a coupon dispensing slot 104, a sensor 105 to sense the proximity of a consumer, and audio/-visual means 106 to attract the attention of a consumer to the POP-CD. In the embodiment shown in FIG. 1, audio/visual means 106 is simply a buzzer or other sounding device and sensing means 105 is an ultrasonic transducer. However, other audio/visual means and sensing means may be employed, for example a visual display of some type and an infrared sensor.

It is also preferable that the POP-CD contain some means 107 for sensing the presence of a coupon 108 in the coupon dispensing slot 104.

The embodiment shown in FIG. 1 is also provided with a solar cell 109 for charging batteries 110 (FIG. 2), although other sources of power may be used.

Access to the POP-CD is preferably obtained by way of some lock and key means 111, 112 as shown by example in FIG. 1.

The embodiment shown in FIG. 1 is also optionally provided with automatic shut off means 113, in the form of a photo transistor which senses when ambient lighting is turned on and off.

Figure 2:
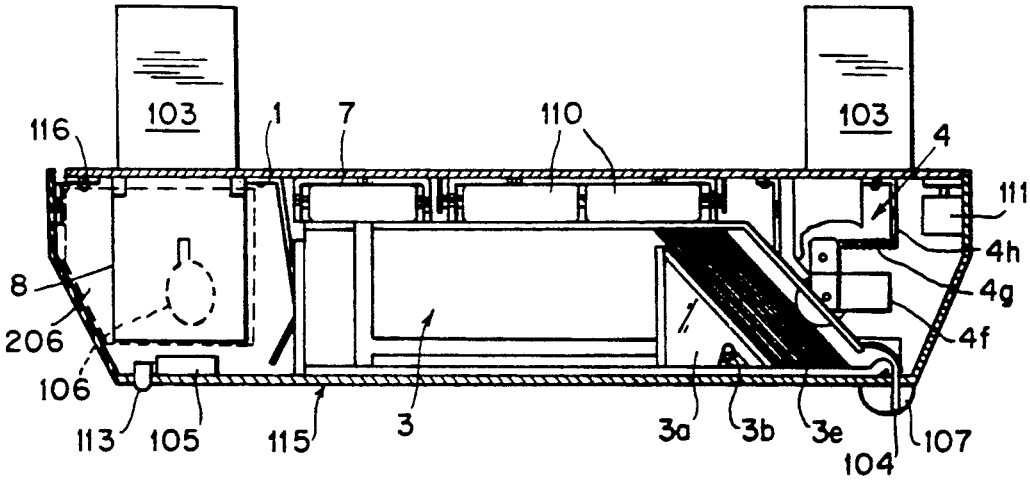
FIG. 2 shows a top view of the POP-CD of FIG. 1 with the top removed to reveal the major components of the system.

FIG. 2 shows the internal components of the exemplary POP-CD of FIG. 1. All the internal components are contained within housing 115 which is provided with mounting means 103 as discussed briefly above and in further detail with reference to FIG. 8. Housing 115 can be made of ABS plastic or any other suitable material.

Power source 110 is preferably nickel cadmium batteries which can be charged by solar cell 109, but other types of batteries may be used without charging, or a transformer may be used to secure power for the POP-CD from an AC line.

Sensing means 105 is preferably an ultra-sonic transducer such as a Polaroid series 7000 (Needham Heights, Mass.) although an infrared sensing means could also be used.

Coupon sensing means 107 is preferably an optical sensor such as an Omron (now, Sen-I-Sys, Plano, Tex.) part number EE-SX-1023-W1 which detects the presence of an exposed coupon 108 in coupon slot 104.

Audio/visual means 106 may be a piezo-electric buzzer such as that manufactured by Monaco Components, Inc. (Glen Head, N.Y.) part #SEP-1112 or a speaker such as Panasonic (Secaucus, N.J.) part number 3P108S, to produce either a beeping sound or a short recorded message to attract the attention of consumers as they come within proximity of the POP-CD. Other audio/visual means such as LEDs, LCDs, electroluminescent panels, video displays or the like can also be used within the scope of this invention.

Access to the POP-CD may be through a hinge 116 provided at the rear of the housing 115 whereby the rear panel of the housing is opened when lock 11 is activated with key 112. Other access means could be easily provided and this is shown only as one example.

A preferred embodiment of the POP-CD also includes a photo-transistor 113 to detect the intensity of ambient light. When the location of the POP-CD becomes dark, such as when a retail establishment closes for the evening, the photo-transistor 113 will automatically shut off the POP-CD to conserve power and extend battery life.

FIG. 2 also shows a coupon tray 3 which occupies most of the interior space of the POP-CD since the electromechanical portions of the POP-CD can be highly miniaturized. Tray 3 is removably held in place by some spring means 1 such as a spring clip as shown in FIG. 2 which biases the tray 3 against a motor assembly 4 which contains means to move coupons out of the tray through coupon slot 104. A preferred embodiment of coupon tray 3 includes a coupon shoe 3*a* that pushes against a stack of promotional material 3*e*, such as coupons, with a constant force using a constant force spring 3*b*. In FIG. 2, tray 3 is shown approximately one third filled with coupons 3*e*.

The remainder of FIG. 2 shows likely positions for a power source 110, such as a plurality of AA batteries, and circuit boards 7 and 8, In the preferred embodiment circuit board 7 controls sensing means 105, e.g. an ultrasonic transducer, and determines when a consumer is in the vicinity of the POP-CD. In this embodiment, circuit board 8 contains all the logic circuits that control the function of the POP-CD once sensing means 105 senses the presence of a consumer. Audio means 106 (e.g. buzzer of speaker) is shown mounted under circuit board 8. In a preferred embodiment a piezo-electric buzzer uses 2 seconds of beeping sound at a frequency of 4.1 KHz to draw attention to the POP-CD. A frequency of 4.1 KHz is ideal due to the ability of the human ear to pick out that frequency above normal levels of background noise. In another embodiment a speaker is used to produce a 10–15 second audible message or longer (much the same as a radio commercial) to not only draw attention to the POP-CD but to supply additional promotional information. A sound storage device 206 is provided when the audio means 106 is a speaker or the like. This storage device can be a microcassette player or a solid state digital device. In a preferred embodiment, a microcassette is used and the tape is rewound each time the message is played. A continuous loop cassette could be used and rewinding would then not be necessary. In the preferred embodiment, the recorded commercial will be repeated every time a person enters in front of the ultra-sonic transducer 105. If visual means are also used to attract the consumer, they would likely be mounted in a visible position rather than under the POP-CD as the audio means 106 is shown.

Various power sources have been tested with the POP-CD. Alkaline batteries with an output of 2000 mAh will have a life of about 60 days if a coupon is ejected every 4 seconds for 12 hours a day. To obtain a much longer battery life, Lithium batteries with a rating of 4000 mAh may be used. In situations where solar panels 109 are used in conjunction with NI-CAD batteries, an almost infinite battery life can be expected since the solar panels will continuously recharge the NI-CAD batteries. Other sources of power such as AC voltage or AC to DC power converters may be used without departing from the scope of the invention.

Figure 3A:
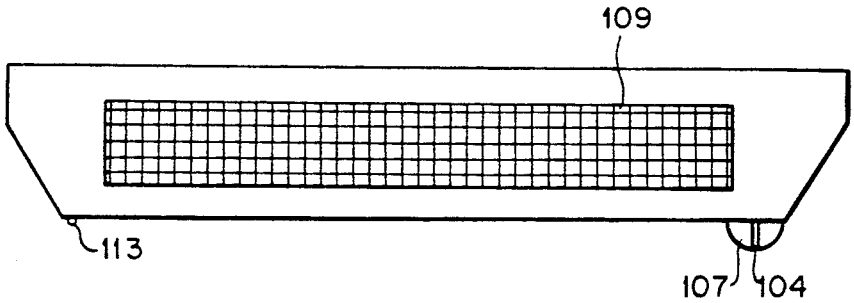
FIG. 3*a* shows a top view similar to FIG. 2, but with top cover in place.
Figure 3B:
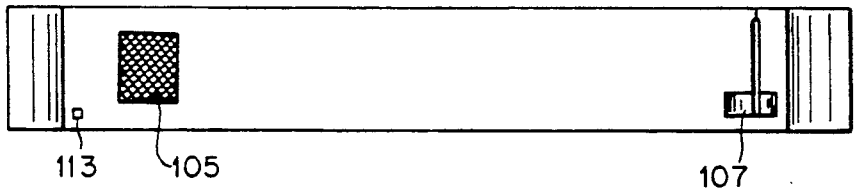
FIG. 3*b* is a side elevational view of the POP-CD shown in FIG. 3*a;*

FIGS. 3*a* and 3*b* show top and front views of the POP-CD without the universal mounting brackets 103. Overall dimensions of the POP-CD may be adjusted to accumulate different amounts and sizes of promotional material without departing from the scope of this invention. A depth of about 3.5" and height of about 2.25" have been found to be good dimensions for use with most retail store shelves. If these dimensions are chosen, approximately 1,000 coupons approximately 2.65"×3.20", 50 lb. glossy paper stock can easily be fitted in coupon tray 3. Those skilled in the art will appreciate that coupon tray 3 could easily be reconfigured to accommodate coupons on a roll, instead of in a stack.

Figure 4:
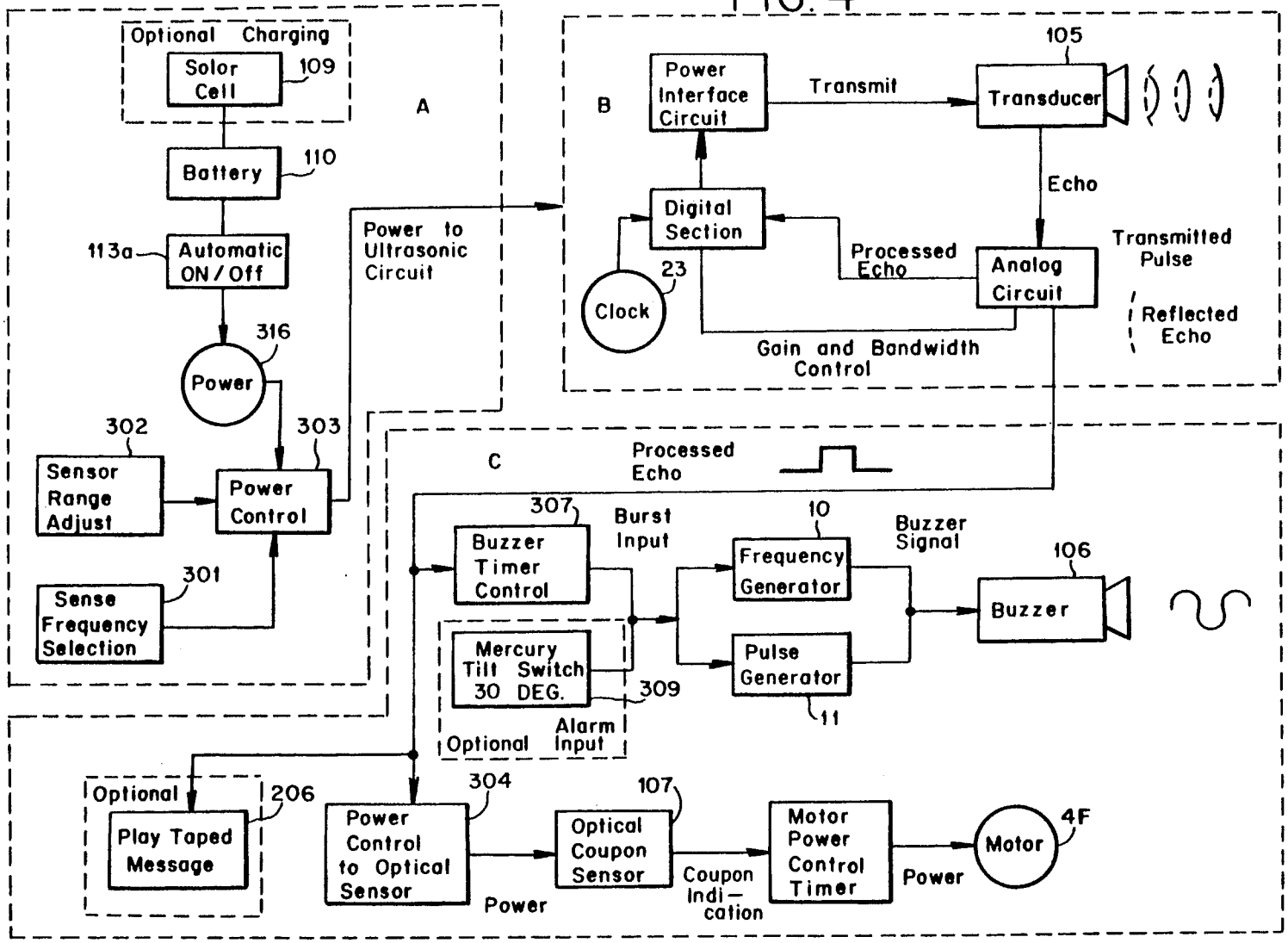
FIG. 4 shows an overall block diagram of the electronics used in a preferred embodiment of the POP-CD.

FIG. 4 shows an overall block diagram of one embodiment of the electronics sections of the POP-CD. In this embodiment, there are 3 major sections of the POP-CD electronics: power section A, sensing section B, and main control section C. Power section A distributes power from the batteries 110 and the optional battery charging from the Solar Cell 109 to the other portions of the electronics and is controlled by the optional Auto Shut Off Circuit 113*a*. The subsection A also contains adjusting means 301, 302 for the POP-CD that tell the ultrasonic circuitry B the limit of how far to look in front of the POP-CD.

Subsection B details the circuitry that sends and receives the ultrasonic pulses. When this section receives a signal from the Power Control 303 in subsection A, the transducer 105 fires a burst of ultrasonic sound, is switched into receive mode and then waits a preset length of time for an echo. If an echo is received, then subsection B sends a processed echo pulse to subsection C.

Upon receipt of the processed echo pulse, subsection C then decides whether to turn on the motor 4*f*, based on whether a coupon is exposed (see FIG. 1). Subsection C also activates buzzer 106 or tape 206 depending on what option is used.

Subsection C can also include an optional mercury tilt switch alarm 309 (such as COMUS, Inc. part #POP-CD 14-0) to detect when the POP-CD is removed from the shelf. This tilt switch 309 will turn on the buzzer 106 continuously until the POP-CD is returned to a level position.

In the preferred embodiment, audio means 106 is a buzzer with a frequency of 4.1 KHz. This frequency was chosen because of the ability of the human ear to pick out that frequency above normal levels of background noise.

In operation of the illustrated embodiment, power control 303 from subsection A, sends a pulse to the power interface circuit 24 which sends power to the electronics in subsection B. When power is turned on, clock 23 sends a frequency of 50 KHz through the digital section 22 and out through the power interface circuit 24 for amplification. This amplified 50 KHz frequency is then sent to the ultrasonic transducer 105 that produces a burst of ultrasonic sound emitted directly in front of the POP-CD. The transducer 105 then changes from a transmitter to a receiver and waits for any echo pulse that may be detected. Sound travels at a rate of 1 foot every 0.89 milliseconds in air and as a result, the effective range of the POP-CD can be adjusted by keeping the transducer 105 in the receive mode for a set period of time. Thus, a target that is 10 feet away from the POP-CD would cause an echo to be received 17.8 ms after the transducer 105 transmitted it. [10 feet out + 10 feet back results in a total travel of 20 feet × 0.89 ms = 17.8 ms.] To reject any targets further than 10 feet away, the pulse from the sensor range adjustment module 302 in subsection A will shut off power to the transducer circuit after 18 ms. By shutting off the circuit, any echo that comes in from further than 10 feet will be ignored, hence a limit on the range. This range can easily be adjusted between, e.g., 1–13 feet to allow for the rejection of opposing shelves or objects that need to be ignored by the POP-CD.

The ultra-sonic transducer 105 sends out a high power burst of sound beyond the range of human hearing during the transmit cycle, however sound intensity decreases by the inverse square law. This means that the intensity of the echo pulse is many times weaker than the transmitted pulse. To account for this weaker pulse, the detector circuit that detects and processes the echo pulse must be able to increase its gain sensitivity to detect low intensity echoes. To do this, the digital section 22 modifies the sensitivity of the analog circuit 21 using the gain + bandwidth control while the transducer awaits the echo. The gain is changed based on time because the longer it takes to receive an echo, the weaker the echo signal will be.

When the analog circuit 21 receives an echo, it processes the very weak echo pulse into a stronger pulse called the processed echo. This signal is sent to the digital section 22 and the digital section then turns off the gain + bandwidth control. This processed echo pulse also begins a series of events in the electronics of subsection C. Those skilled in the art will realize that there are other methods of detecting the proximity of a consumer such as with infrared detectors. However, the use of different detectors does not go beyond the scope of this invention.

Subsection C shows a block diagram of one embodiment of the coupon dispensing and audio/visual electronics. This circuit becomes active upon receipt of a processed echo pulse from subsection B. Several things take place simultaneously within this subsection when a processed echo pulse is received. Power is supplied to the coupon sensor 107 via the power control to sensor module 304. This results in a "coupon/no coupon" indication from the sensor 107. In the event that a coupon is still in the exit slot (see, e.g., FIG. 1), the sensor 107 will indicate a "coupon" to the motor control timer 6 and the motor 4*f* will not be turned on and no additional coupon will be dispensed. In the event that no coupon is in the exit slot (see, e.g. FIG. 3*a*), then the sensor 107 will send a "no coupon" signal to the motor power control timer 6 and this module will turn on the motor 4*f* for a pre-set length of time to eject a coupon from the coupon tray 3 (described in further detail with reference to FIGS. 6 and 7) out through the exit slot to be removed by a consumer.

Another event that is triggered by the presence of a processed echo pulse is the activation of audio/visual means 106, shown here as the buzzer discussed above. The processed echo pulse is received by the buzzer timer control 307 that turns on both the frequency generator 10 and the pulse generator 11. The frequency generator module 10 is a clock oscillator that is set at 4.1 KHz and is gated to the buzzer 106 by the pulses from the pulse generator module 11. The resulting signal to the buzzer 106 is a 2 second long "beeping" sound where for 2 seconds the buzzer 106 turns on and off quickly to produce a beeping sound. This beeping sound is used to attract attention to the POP-CD.

The optional alarm circuit is also shown in subsection C. The mercury tilt switch module 309 is used to override the buzzer timer module 307 and turn on the buzzer 106 any time the POP-CD is not in a horizontal position. The buzzer 106 will continue to beep as long as the POP-CD is tilted. Those skilled in the art may realize other methods of tamper detection without departing from the scope of this invention.

An optional method of attracting attention to the POP-CD, as well as supplying additional promotional information to the consumer is the addition of a 10–15 second (or longer) audible message that is played through a speaker in the POP-CD. This optional taped message 206 can be a looped taped message on magnetic audio tape that will begin upon receipt of the processed echo pulse. The message will play through to its entirety and then a strip of metal on the tape will be used to reference the start of the message and will cue up the tape for the next time a processed echo pulse is received. Other methods of message storage/playback such as solid state digital recording or like methods are within the scope of this invention.

Figure 5:
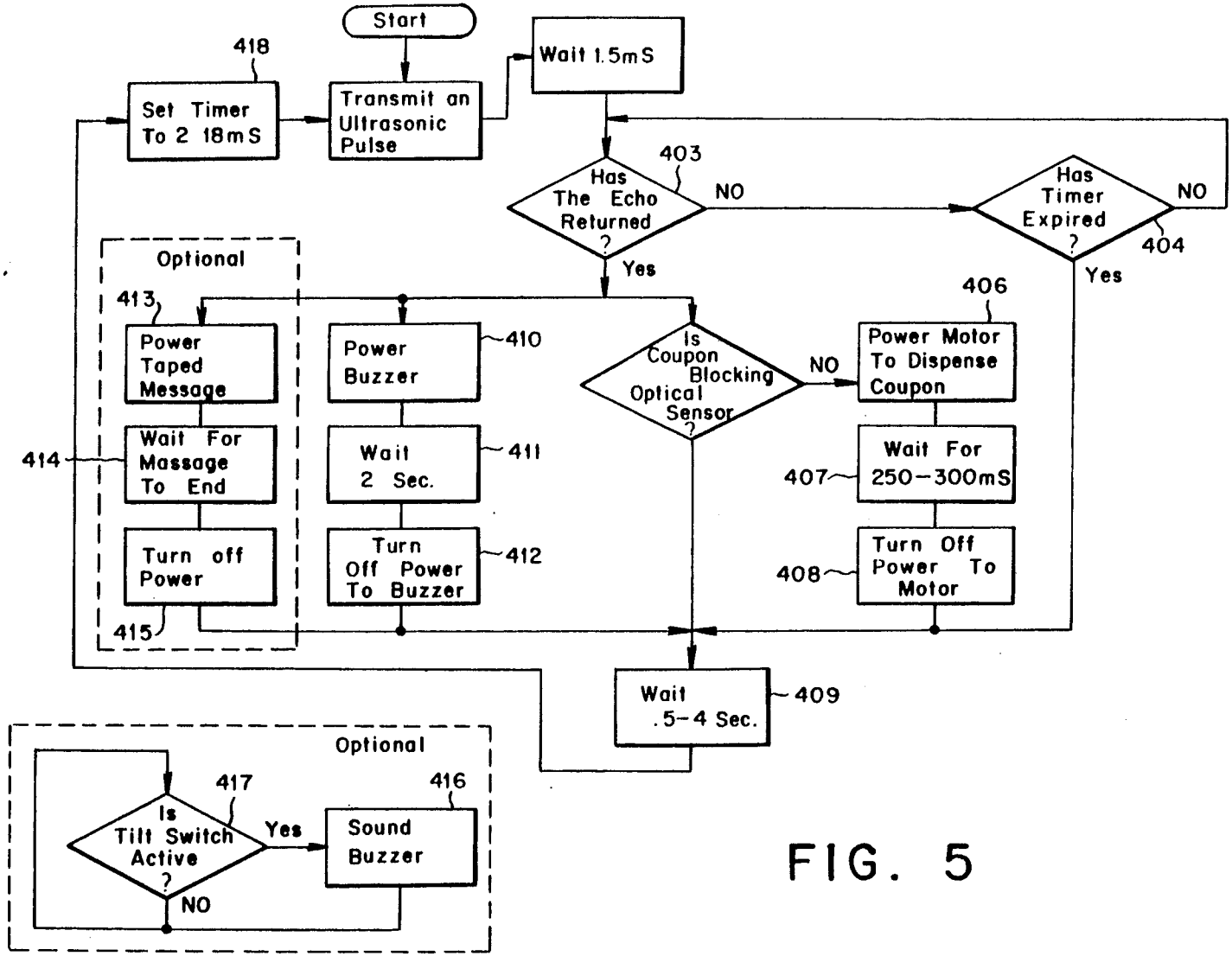
FIG. 5 shows a flow chart of the logic used by the electronics in FIG. 4.

FIG. 5 shows a block diagram of the logic steps the Automatic Coupon Machine POP-CD follows during operation of the above-described preferred embodiment. The beginning of the sequence starts with the transmission 401 of an ultra-sonic pulse. At this point the ultra-sonic transducer is in the "transmit" mode. Immediately following the transmission, there is a delay 402 of 1.5 ms before the ultra-sonic transducer is changed to the "receiver" mode. This delay is used to reject the echo caused by the transducer cover grill at the front of the POP-CD. While the transducer is in the receiver mode, it waits for an echo pulse. A first branch 403 decides if an echo has been sensed. If "NO", the POP-CD then proceeds to a second branch 404 to decide if the timer has expired. This timer sets the range of the transducer. If the timer hasn't expired, then the POP-CD returns to branch 403 and continues to wait for an echo. If the timer has expired, then the POP-CD waits 409 for the fire rate frequency clock to time out 0.5–4 seconds and then moves up to 418 set the range timer 2–18 ms and then sends off another ultrasonic burst 401 to begin the process all over again. If, however, any echo is returned at branch 403, then there are 3 paths the POP-CD goes to simultaneously. The first path decides 405 if there is a coupon blocking the coupon sensor. If "NO", then the POP-CD sends power 406 to the motor to dispense a coupon. The POP-CD then times 407 how long the power is sent to the Motor (250–300 ms to dispense one coupon) and when that time is expired, the POP-CD shuts off the motor 408 and then proceeds to wait 49 for the next fire cycle. If there is a coupon blocking the optical sensor 405, then the POP-CD does nothing to the motor.

With a "YES" decision at branch 403 (echo returned), the POP-CD also applies power 410 to the buzzer or 413 to the audio message. The POP-CD then allows 411 either 2 seconds of beeping or it waits 414 for the message to play to the end. The POP-CD then turns off power 412 to the buzzer or turns off power 415 to the message circuit and waits 409 for the next firing cycle.

When the firing cycle wait 409 times out (typically 0.5–4 seconds), then a timer is set 418 to determine the range of the POP-CD. The setting 418 of this timer determines how long the ultrasonic transducer will remain in the receive mode (typically 2–18 ms). Once this timer is set 418 then the process begins all over again with the ultrasonic transducer firing a burst of ultrasonic sound 401.

Figure 6C:
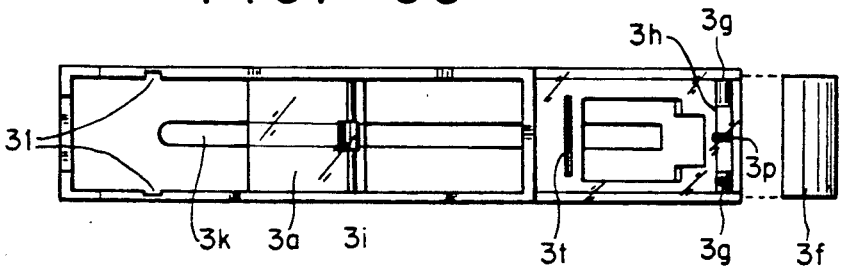
FIGS. 6*a*–6*c* show views of one embodiment of a tray used to hold the promotional material and its associated components where
Figure 6A:
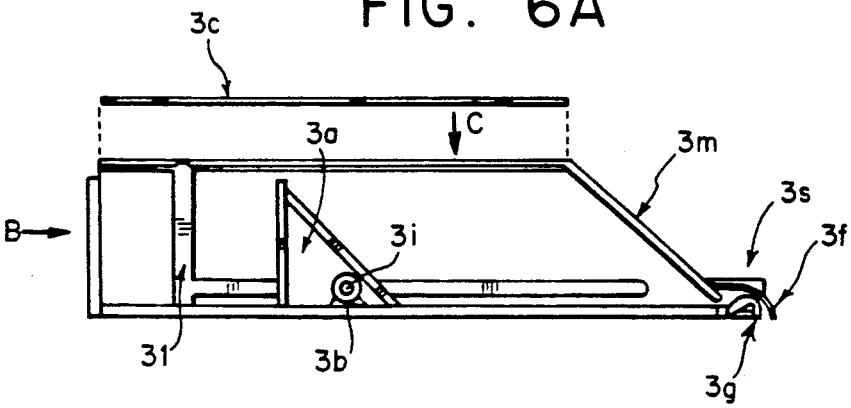
Figure 6B:
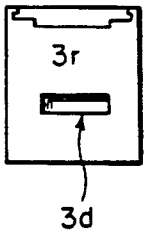

FIG. 6 shows a detailed drawing of an exemplary coupon tray 3 and its components. FIG. 6*a* is a top view; 6*b* is a side elevation looking in the direction B shown in FIG. 6*a*; and FIG. 6*c* is a side elevation looking in the direction C shown in FIG. 6*a*.

The illustrated coupon tray 3 is designed to hold up to 1000 individual pieces of promotional material with dimensions of 2.65" W×3.20" H×0.005" thick (unfolded). This promotional material is placed inside the coupon tray after removing tray cover 3*c*. The promotional material coupons 3*e* (see FIG. 2) are pressed between the front plate 3*m* and coupon shoe 3*a* and held by a constant force spring 3*b* secured to the coupon shoe with rod 3*i* and attached to the front of the coupon tray with a spring pin 3*p*. If a non-constant force spring were used pushing against the back of the shoe, then there would be a varying force depending upon how many coupons are left in the tray. This would be a problem in pushing the coupons out of the tray. Therefore, a constant force spring 3*b* is used in this embodiment. This spring 3*b* rides along track 3*k* to keep the spring away from the edge of the coupons.

The coupon shoe 3*a* rides along tracks 31 and is held in place with rod 3*i*. The coupons are pressed up against the coupon tray faceplate 3*m* which has an opening cut in it to allow for a roller assembly to come into contact with the next available coupon. When the POP-CD turns on the motor to dispense a coupon, the roller assembly pushes the next available coupon down into the nose 3*s* of the coupon tray and against the coupon separator 3*h* and coupon guide posts 3*g*. The separator is used to separate the next available coupon from the coupons remaining in the tray while the coupon guide posts guide the coupon into the dispensing chute 3*f*. This dispensing chute guides the coupon out through the coupon exit slot in the front of the cover assembly. (See FIG. 1.)

Also located on the coupon tray face plate 3*m* is locator slot 3*t*. This slot is used to secure the front of the coupon tray to the backplate of the POP-CD. (See FIG. 2.) Another slot 3*d* is located in the coupon tray backplate 3*r*. This slot 3*d* is used to align the rear of the coupon tray with the back plate of the POP-CD. (See FIG. 2.)

Figure 7A:
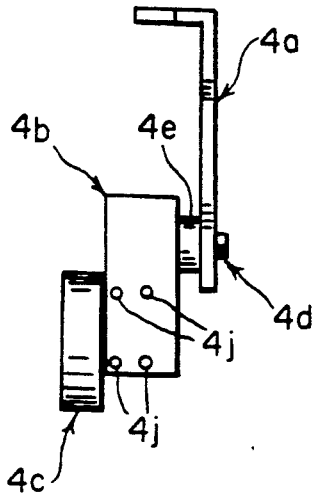
FIGS. 7*a* and 7*b* show detailed side and top views of a motor for dispensing coupons and its associated support means.
Figure 7B:
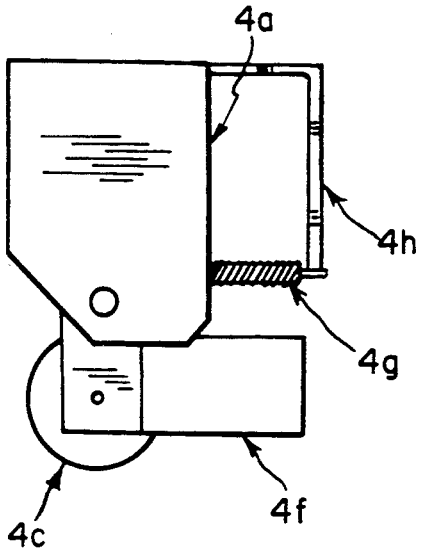

FIG. 7 shows the motor assembly for moving coupons out of the coupon tray as described above. The motor and its associated assembly are mounted on a main support plate 4*a*. This support plate can be secured to the back plate of the POP-CD with the use of machine screws threaded into the back plate. (See FIG. 2.)

The motor 4*f* can be a Port-E-Scap U.S., Inc. (Hauppauge, N.Y.) Model #MU-915L61-205-98.70 which is a hollow core motor that has a very small inertial load thus requiring very little current with respect to an iron core motor. This type of motor lends itself well for this design because it has a right angle geared down head with a gear ratio of 98.7:1. This right angle drive allows the motor to be mounted parallel with coupons to minimize the width of the POP-CD. Those skilled in the art may realize other methods of dispensing the coupons from the coupon tray, such as with the use of a solenoid, without departing from the scope of this invention.

Attached to the output shaft of the motor is a roller assembly 4*c*. This roller assembly has an outside coating of rubber to maximize the friction between the coupon and the roller so there is no slippage when dispensing a coupon. Also attached to the motor 4*f* is the motor mounting bracket 4*b*. This bracket is attached to the motor using screws 4*j*. This motor mounting bracket it attached to the main support plate 4*a* using a screw 4*d* and a spacer 4*e*. Screw 4*d* is adjusted to allow for free movement of the motor bracket 4*b* pivoting on the screw 4*d*. Thread lock is used between screw 4*d* and the main support plate 4*a* to keep the screw 4*d* from tightening on the motor. Spring 4*g* is attached between the motor support bracket 4*b* and spring post 4*h* to keep tension between the roller 4*c* and the next coupon in the coupon tray.

Figure 8:
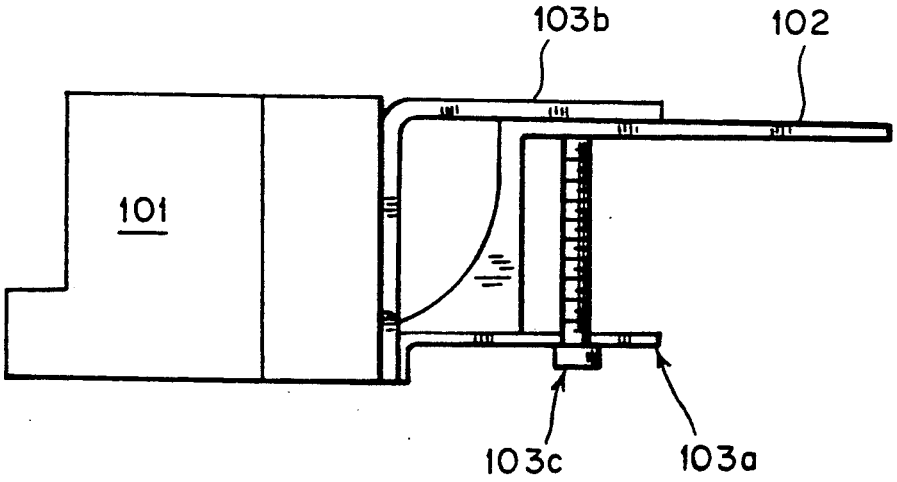

FIG. 8 shows a side view of the POP-CD Mounting Clamps. This universal mounting clamp 103 comprises top plate 103*b* which is fastened to the back plate or is part of the back plate of POP-CD 101 and is used as the top portion of the mounting clamp. Bottom plate 103*a* is attached to top plate 103*b* or the back plate of POP-CD 101 and becomes the bottom support for the mounting clamp. To secure the POP-CD 101 to the shelf, screw 103*c* is threaded through the bottom support plate 103*a* and is tightened on shelf 102. A typical retail store shelf is illustrated here, however, with this type of universal clamp, the POP-CD 101 can be attached to almost any type of shelf. This clamp design also allows for the POP-CD to be as close to the front of the shelf as possible. This eliminates the problem of the POP-CD being too far from the shelf, thus reducing the chance of the POP-CD sticking out too far into the aisle. The screw 103*c* can be Hex Head or Torquex Head variety to reduce the chance of tampering. Those knowledgeable in the field may recognize other methods of mounting the POP-CD such as the use of a free standing support without deviating from the scope of this invention.

Although the invention is described and illustrated with reference to a plurality of embodiments thereof, it is to be expressly understood that it is in no way limited to the disclosure of such preferred embodiments but is capable of numerous modifications within the scope of the appended claims.

What is claimed is:

1. A point-of-purchase coupon dispenser comprising:

coupon storage means for storing a plurality of coupons, coupon exit means, and means for ejecting coupons one at a time from said storage means through said exit means;

audio/visual means for attracting the attention of a consumer; and activation means having consumer sensing means for sensing the presence of a consumer, said sensing means being operatively connected to said audio/visual means and said means for ejecting coupons, whereby when proximity of said consumer is sensed, said audio/visual means and said means for ejecting coupons are activated.

2. The coupon dispenser as claimed in claim 1, further comprising coupon sensing means for sensing the presence of a coupon in said exit means;

said coupon sensing means operatively connected with said means for ejecting coupons whereby activation of said means for ejecting coupons is interrupted if the presence of a coupon in said exit means is sensed.

3. The coupon dispenser as claimed in claim 2, wherein said coupon sensing means is an optical sensor.

4. The coupon dispenser as claimed in claim 1, wherein said consumer sensing means is an ultrasonic detector.

5. The coupon dispenser as claimed in claim 4, wherein said ultrasonic transducer is adjustable in sensing range.

6. The coupon dispenser as claimed in claim 1, wherein said audio/visual means is a buzzer.

7. The coupon dispenser as claimed in claim 1, wherein said audio/visual means is a speaker and an audio message storage device.

8. The coupon dispenser as claimed in claim 7, wherein said audio message storage device is a cassette player.

9. The coupon dispenser as claimed in claim 1, further comprising a self-contained power source.

10. The coupon dispenser as claimed in claim 9, wherein said self-contained power source is a battery.

11. The coupon dispenser as claimed in claim 1, further comprising mounting means for mounting said machine on a retail store shelf.

12. The coupon dispenser as claimed in claim 1, further comprising automatic shut-off means.

13. The coupon dispenser as claimed in claim 1, wherein said coupon storage means comprises a removable coupon tray.

14. The coupon dispenser as claimed in claim 1, wherein said means for ejecting coupons is a motor with roller means.

15. The coupon dispenser as claimed in claim 13, wherein said removable coupon tray comprises a coupon shoe and a constant spring means to hold a plurality of coupons pressed against a plate.

16. The coupon dispenser as claimed in claim 5, further comprising switching means and clock means connected to said ultrasonic transducer whereby said transducer is placed in a transmit mode for a predetermined time and placed in receive mode for an adjustable period of time, whereby the period of time said transducer is in receive mode determines the sensing range of the transducer.

17. A point-of-purchase coupon dispenser comprising:

coupon storage means for storing a plurality of coupons, coupon exit means, and means for ejecting coupons one at a time from said storage means through said exit means;

audio/visual means for attracting the attention of a consumer;

activation means operatively connected to said audio/visual means and said means for ejecting coupons to effect activation thereof; and mounting means for mounting said machine on a retail store shelf, wherein said mounting means comprises an upper and lower bracket and a tightening screw.

18. A point-of-purchase coupon dispenser comprising:

coupon storage means for storing a plurality of coupons, coupon exit means, and means for ejecting coupons one at a time from said storage means through said exit means;

audio/visual means for attracting the attention of a consumer;

activation means operatively connected to said audio/visual means and said means for ejecting coupons to effect activation thereof; and tamper detection means comprising a mercury switch operatively connected with said audio/visual means whereby said audio/visual means is activated when said machine is moved out of a horizontal position.

19. A point-of-purchase coupon dispenser comprising:

coupon storage means, including a removable coupon tray for storing a plurality of coupons, said removable coupon tray having a coupon shoe and a constant spring means for holding a plurality of coupons pressed against a plate;

coupon exit means;

means for ejecting coupons, one at a time, from said storage means through said exit means, wherein said means for ejecting coupons is a motor with a roller and said plate is provided with an opening whereby said roller contacts a coupon pressed against said plate;

audio/visual means for attracting the attention of a consumer; and activation means operatively connected to said audio/visual means and said means for ejecting coupons to effect activation thereof.

20. A point-of-purchase coupon dispenser comprising:

coupon storage means for storing a plurality of coupons, coupon exit means, means for ejecting coupons one at a time from said storage means through said exit means, and coupon sensing means for sensing the presence of a coupon in said exit means;

audio/visual means for attracting the attention of a consumer; and activation means being operatively connected to said audio/visual means, said means for ejecting coupons and said coupon sensing means, said activation means activating said audio/visual means and selectively activating said means for ejecting coupons when said coupon sensing means senses the lack of a coupon in said coupon exit means.

* * * * *